United States Patent [19]

Parekh

[11] Patent Number: 4,625,214

[45] Date of Patent: Nov. 25, 1986

[54] DUAL GRIDDED REFLECTOR STRUCTURE

[75] Inventor: Sharad V. Parekh, Robbinsville, N.J.

[73] Assignee: RCA Corporation, Princeton, N.J.

[21] Appl. No.: 661,163

[22] Filed: Oct. 15, 1984

[51] Int. Cl.[4] ..... H01Q 19/195

[52] U.S. Cl. ..... 343/756; 343/781 P

[58] Field of Search ..... 343/756, 779, 781 P, 343/835, 836, 909

[56] References Cited

U.S. PATENT DOCUMENTS 3,096,519 7/1963 Martin ..... 343/756
3,898,667 8/1975 Raab ..... 343/756

FOREIGN PATENT DOCUMENTS 326809 2/1958 Switzerland ..... 343/756

OTHER PUBLICATIONS

*The Handbook of Antenna Design,* vol. 1, Editors A. W. Rudge et al., Peter Peregrinus Ltd. of London, England, published on behalf of Institute of Electrical Engineers in 1982.

"The SBS Communication Satellites—An Integrated Design", by H. A. Rosen, printed for EASTCON in 1978, designed CH1352-4/78/0000-0343.

"Advanced Composite Structures for Satellite Systems", in RCA Engineer, Jan./Feb. 1981.

"Optimized Design and Fabrication Process for Advanced Composite Spacecraft Structures", by V. F. Mazzio et al., 17th Aerospace Sciences Meetings, New Orleans, LA., Jan. 15-17, 1979, Paper 79-0241, American Institute of Aeronautics and Astronautics.

*Primary Examiner*—Eli Lieberman

*Attorney, Agent, or Firm*—Joseph S. Tripoli; Robert L. Troike

[57] ABSTRACT

A dual gridded antenna reflector system and method for constructing the same is disclosed. The reflector system comprises a pair of reflector dishes each having a grid of parallel conductors. One of the reflector dishes is mounted over the other reflector dish by linear support ribs therebetween such that the conductors of the one reflector dish are perpendicular to the conductor of the other reflector dish. The linear support ribs are placed perpendicular to or parallel to the conductors of the overlapped reflector and are placed substantially outside of the high field region across the aperture of the overlapped reflector.

11 Claims, 7 Drawing Figures

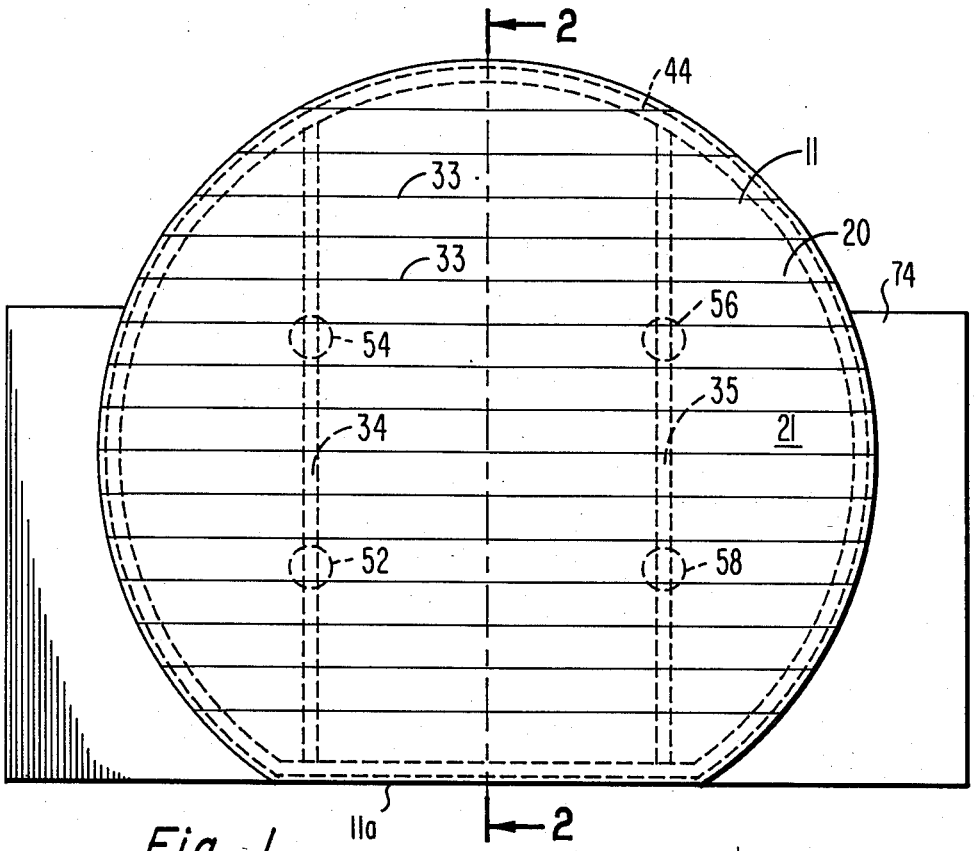
Fig. 1
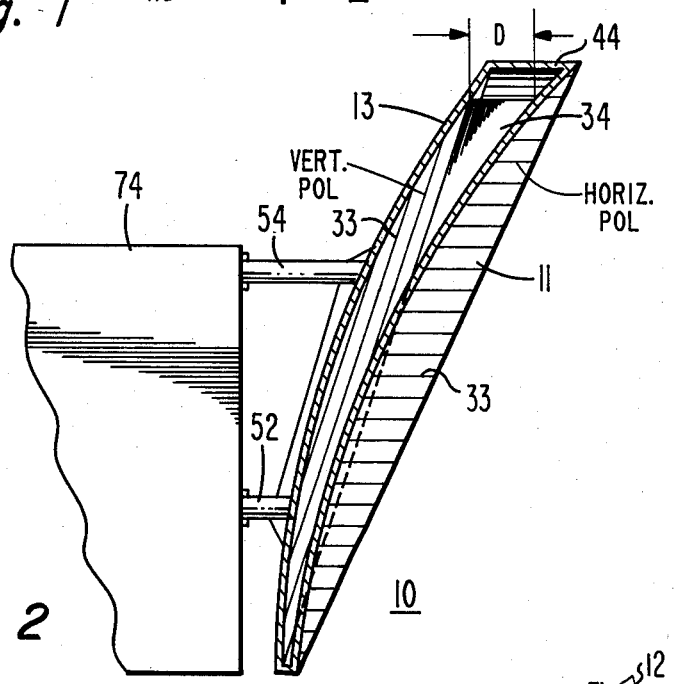
Fig. 2
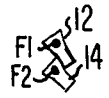

DUAL GRIDDED REFLECTOR STRUCTURE

This invention relates to an antenna reflector structure for a frequency or spectrum reuse antenna system. In particular the structure includes two overlapping dishes where each dish comprises a grid of linear polarizing metallic conductors with the grid on one dish oriented orthogonal with respect to the grid on the other.

An antenna system which achieves frequency reuse by orthogonally polarized sources and reflectors finds wide use in satellite applications. It is also desirable in such applications that the antenna be compact and of light weight. Each of the orthogonally polarized reflectors includes a grid of closely spaced parallel conductors which are oriented parallel to one of two orthogonal linear polarization sources. An example of such an antenna system is illustrated in U.S. Pat. No. 3,898,667. The antenna structure can be formed by two parabolic dishes with one dish containing a first grid of parallel conductors oriented in a first direction and aligned with the polarization of the first source and a second reflector overlapping the first reflector with its grid of parallel conductors oriented orthogonal to the first grid of parallel conductors and aligned with the polarization of the other source. In U.S. Pat. No. 3,898,667, the reflectors are overlaid with the respective focus points noncoincident. A dual gridded reflector structure is also described in U.S. Pat. No. 3,096,519, in an article entitled "The SPS Communications Satellites —An Integrated Design", by H. A. Rosen, designated CH1352-4/78/000-0343, published by the IEEE, pages 343 to 347. In application Ser. No. 408,503, filed Aug. 11, 1982, now U.S. Pat. No. 4,575,726, the present assignee, two parabolic reflector dishes are spaced one over the other and joined to each other by a rib structure. The above mentioned patents and application are incorporated herein by reference. The rib structure, which is secured between and supports and forms a part of the structure, is made generally of dielectric type material and in the application includes an annular member that extends about the periphery of the reflector dishes where the dishes overlap each other. The rib structure further includes a second annular rib inside and concentric with the first and this second rib is also joined to the two parabolic dishes. A plurality of radially extending ribs extend between the first and second annular ribs.

The ribs are of sandwich construction of multi-ply polyparabengamide fabric epoxy-reinforced sheets and single ply polyparabengamide fabric-reinforced honeycomb core. These ribs are considered to be made of RF transparent (pass radio frequencies) material.

The ribs, however, cause changes in the relative phase delay of the signals passing through the ribs and as such adversely effect the signals passing through to the overlapped reflector dish and distort the pattern characteristics of the antenna.

In accordance with one embodiment of the present invention the support ribs located between two overlapped reflector dishes are linearly oriented such as to be either perpendicular or parallel to the direction of the polarizing conductors of the overlapped reflector dish so as to produce minimum distortion to those signals propagated to or reflected from the polarizing conductors. These linear support ribs are also spaced as far as practical outside the region of high field intensity.

In the drawing:

FIG. 1 is a front elevation view of the reflector system in accordance with one embodiment of the present invention;

FIG. 2 is a cross section of the antenna system taken along lines 2—2 of FIG. 1;

Figure 3:
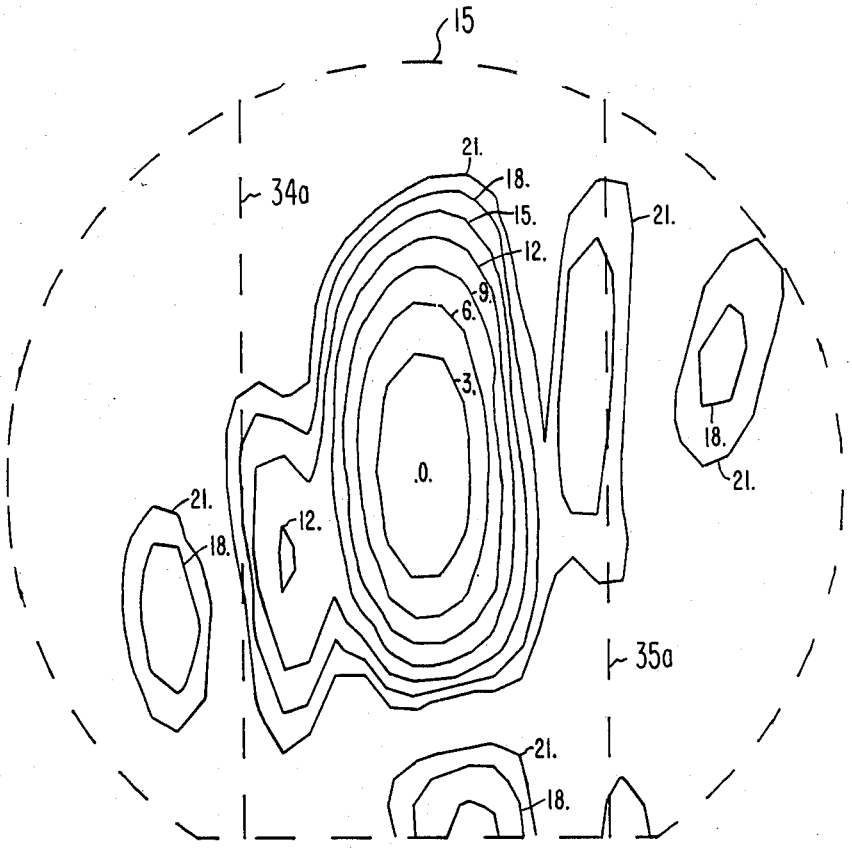
FIG. 3 is a typical field distribution for the type of antenna shown and a sketch of the desired placement of the ribs for such field distribution.

Referring to FIGS. 1 and 2 the communication antenna reflector assembly structure 10 comprises a first parabolic reflector dish 11 mounted in offset manner over a second parabolic reflector dish 13. Each reflector dish is in the shape of a truncated circular section of a parabola of revolution and having reflecting surfaces described by the following equations: $U^2+V^2=4fW$, where U and V are coordinates of any point on the reflecting surface and f is the focal length of the reflector. This equation describes the surface of revolution from axis W and centered at $U=V=W=0$. The centroid is commonly known as the vertex. The vertex for the section shown in FIG. 1 is near the mid-point of the bottom linear edge 11*a* or 13*a*.

The reflector dishes 11 and 13 are each, for example, constructed of a honeycomb core formed of a Kevlar fabric epoxy-reinforced material, preferably a DuPont Kevlar fabric style 120. The core may have a thickness of, by way of example, one-eighth to one-half inch. Kevlar is an E. I. DuPont registered trademark for a polyparabenzamide material available as fibers or as a woven fabric. The core comprises side by side ribbons of fabric, in undulating shape, which are bonded to one another to form the hexagonal cells of a honeycomb, each cell having a length dimension orthogonal to the ribbon direction. The honeycomb core is formed into a paraboloid of the shape described above.

A first face sheet over the core comprises two plies or layers of Kevlar fabric reinforced with epoxy material. The face sheet over the face of the honeycomb core may comprise, however, fewer or more than two plies. The layer is bonded to the face of the core with its warp (the term "warp" refers to the direction in which the primary fibers run parallel, the secondary fibers being orthogonal to those fibers and are known as "filled") at an angle to the ribboned direction. By way of example, this angle may be 45°. The outer layer is at a 0° warp or the ribbon direction.

Secured over this outer layer is a grid layer 20. The grid layer 20 comprises a grid of parallel spaced electrical conductors 33, such as copper strips, which are secured in an RF transparent medium such as a polymide material (one such material is known as Kapton, a trademark of the DuPont Corporation). The grid of conductors 33 extend normal to the ribbon direction. The gridding may also be formed by applying separate flexible curved dielectric strips containing printed or otherwise formed conductors thereon with these dielectric strips having printed conductors thereon being individually placed over the parabolic dish. The dielectric strips are thin and are appropriately curved to lay in the concave surface of a parabolic dish. One example of a construction technique in which a single strip assembly of conductors is bonded to a parabolic dish is described and illustrated in U.S. Pat. No. 4,001,836. The purpose of the grating is to allow independent simultaneous operation of two orthogonal linear polarizations.

The lower of back face sheet of the reflector dish also comprises two plies or layers of Kevlar fabric reinforced with epoxy material. These layers are bonded to the lower face of the core.

The conductors 33 extend substantially across the reflector dishes 11 or 13 and appear parallel to each other as viewed in the direction of propagation. The conductors 33 of grid 21 of dish 11 are horizontal, for example, for receiving horizontally polarized waves at a horizontally polarized horn 12 at feedpoint F1 of FIG. 2 and the grid 22 of conductors 33 of dish 13 are oriented orthogonal to the grid of conductors 33 of dish 11 and therefore are responsive to vertically polarized signals from a vertically polarized horn 14 at feedpoint F2. The feedpoints of F1 and F2 represent the focuses of the two offset reflector dishes 11 and 13. The two reflector dishes 11 and 13 and feed horns are offset mounted such that their focal axes are parallel and slightly offset from each other in a manner similar to that in the above cited U.S. Pat. No. 3,898,667. The horns 12 and 14 are tilted to center the illumination on the center of the dishes 11 and 13.

The two reflector dishes 11 and 13 are mounted in an overlapping relationship to each other by a common stiffener support rib network forming a super-sandwich construction. By the term "super-sandwich" it is meant a construction comprising several sandwich layers which are combined in a further sandwich construction, namely, multiple sandwich layers combined to form a composite sandwich whose elements are sandwich constructions. It has been found that by virtue of this construction, two waves can be stacked one above the other, resulting in an optimum packaging of the antenna reflecting surfaces within a limited volume. This is highly desirable in a satellite environment.

It has been found that these stiffener support ribs between the two reflecting dishes disturb the desired antenna pattern. In the antenna construction of the previously cited application Ser. No. 408,503 filed Aug. 16, 1982 the rib structure included an inner circular ring and four radial spokes. An experimental test conducted on this structure revealed that this type of geometry led to degradation of the antenna gain performance. It was determined that the inner ring was a predominant cause of this performance degradation.

The feed source transmits or receives two orthogonal linearly polarized signals P1 and P2. Assuming that the top dish 11 acts as a reflector for energy for the horizontal polarization P1, for example, then it is almost opaque to signals of the orthogonal vertical polarization P2. The vertical polarization signals P2 are reflected by the bottom or overlapped reflector 13. The P2 signals in this case are effected adversely by the stiffener support ribs which are located between the two dishes. In the case of the above cited application this interferring structure is the inner circular ring and the radial spokes. The outer circular ring near the periphery has little or no effect since it is out of the high field region. These stiffener support ribs can introduce unequal phase delays to the P2 signals which produce blockages of the P2 signal. The support ribs convert part of the desired signal to be radiated from the wanted linear polarization to an orthogonal polarization and hence cause loss in the antenna gain. Hence, in general, the presence of these support ribs causes a loss in the performance of the P2 vertically polarized signals. Total elimination of all rib members is desirable but not generally possible because of mechanical constraints. The two reflector dishes should be held together in a combined structural support system.

In accordance with the teachings of the present invention the location and orientation of the support ribs can be optimized to have a minimal impact on the electrical performance of the P2 vertically polarized signals. In accordance with the teaching herein an improved antenna structure is provided by first determining the field distribution across the aperture of the overlapped antenna reflector dish and then orienting any supports outside the high field region. The field distribution can be determined by well known equations or by measurements. See, for example, *The Handbook of Antenna Design,* Volume 1, Editors A. W. Rudge et al., published by Peter Peregrinus Ltd. of London England on behalf of Institute of Electrical Engineers, 1982, pp. 90–196. For the case of an antenna to illuminate the continential United States region, for example, the antenna aperture would have typical field distribution as shown in FIG. 3. This field distribution is derived through the use of a plurality of horns to achieve the shaped beam pattern. This can be determined by well known equations as can be found, for example, in the above cited handbook. In this example, the overlapped or lower reflector dish 13 periphery is shown by the quasi-circular broken line 15. In accordance with the teachings of the present invention, in order to minimize the effect of the support ribs across the reflector 13 the support ribs are located as indicated by long dashed lines **34*a* and 35*a* in FIG. 3** outside the high intensity field regions. The intensity of the field is indicated generally by the curves and the indicated decibel (db) levels from the maximum or zero at the center. The outer most curve represents 21 db down from the maximum or −21 db. Note that the ribs are well outside the −15 db region.

Also in accordance with the present invention, the support ribs, rather than being curved as the inner circle rib or at a diagonal as the radial ribs in the referenced application, are oriented either parallel or perpendicular to the conductors of the overlapped reflector dish 13 which in the this case is in vertical direction. By making these support ribs perpendicular or parallel to the rear reflector conductor polarization the conversion to the undesired orthogonal polarization is minimized. Therefore, in accordance with the teachings herein, the support ribs are located outside the high field regions such as to minimize interaction with the high field regions, and, the support ribs are oriented either parallel or perpendicular to the polarization of the rear reflector dish.

Figure 4:
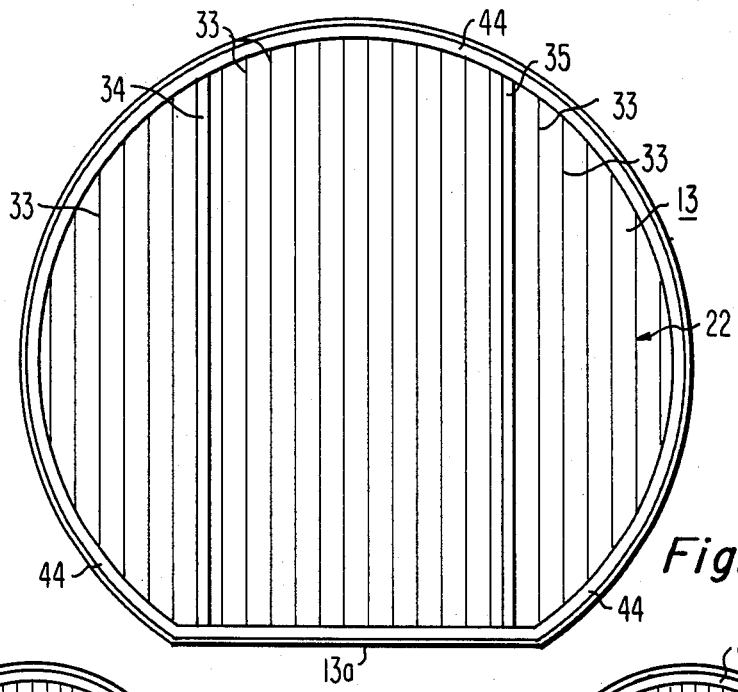
FIG. 4 is a sketch of the FIG. 1 reflector system with the front dish removed illustrating the position of the support ribs according to one embodiment of the present invention for the field distribution indicated in FIG. 3.

In accordance with these teachings, as can be seen by dashed lines in FIG. 1, the support ribs 34 and 35 separate the two reflector dishes 11 and 13 and extend parallel to the grid 21 of conductor 33 of the rear antenna reflector dish 13 and extend perpendicular to the grid 22 of conductors 33 in the forward reflector dish 11. The support ribs 34 and 35 extend parallel to each other and are connected to annular rib 44 which extends about the periphery of the reflectors 11 and 13. The support ribs 34 and 35 are generally linear and are parallel to the conductors in the reflector dish 13 and the depth D of these ribs follows the shape of the reflector dishes 11 and 13 and the desired offset spacing. For example, this spacing varies from one to five inches. The annular rib 44 follows the boundary of the dishes and is straight near the truncated bottom edges 11*a* and 13*a*. FIG. 4 illustrates a front view of the rear reflector dish 13 and rib network with the forward reflector dish 11 removed.

Figure 5:
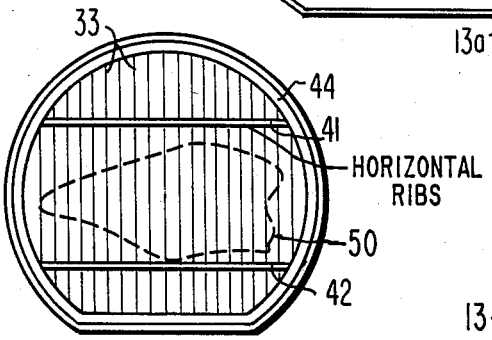
FIG. 5 illustrates the position of the support ribs for another embodiment of the present invention.
Figure 6:
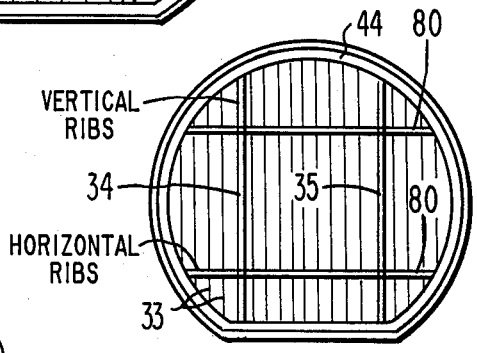
FIG. 6 illustrates the position of the support ribs for additional support where the field distribution of FIG. 3 is required.

For a different high field distribution across the aperture of the overlapped antenna dish 13 which is broad in width and narrower in height as represented by the dashed line 50 in FIG. 5 the support ribs 41 and 42 are oriented orthogonal to the rear grid conductors 33 to be out of the high field region. The ribs 41 and 42 would be spaced sufficiently apart from each other to be outside the high field region as represented by line dashed lines 50. These ribs 41 and 42 may likewise be affixed to the annular rib 44 that extends near or about the periphery of the dishes.

It may be that additional structural support ribs are required for the structure and field distribution illustrated in FIGS. 1 and 3. This may be achieved with limited additional loss by other ribs parallel to the ribs illustrated by ribs 34 and 35 or where required for strength near the center ribs 80 perpendicular to ribs 34 and 35. The ribs 80 and 34 and 35 are also located as far as possible outside the high field region.

Figure 7:
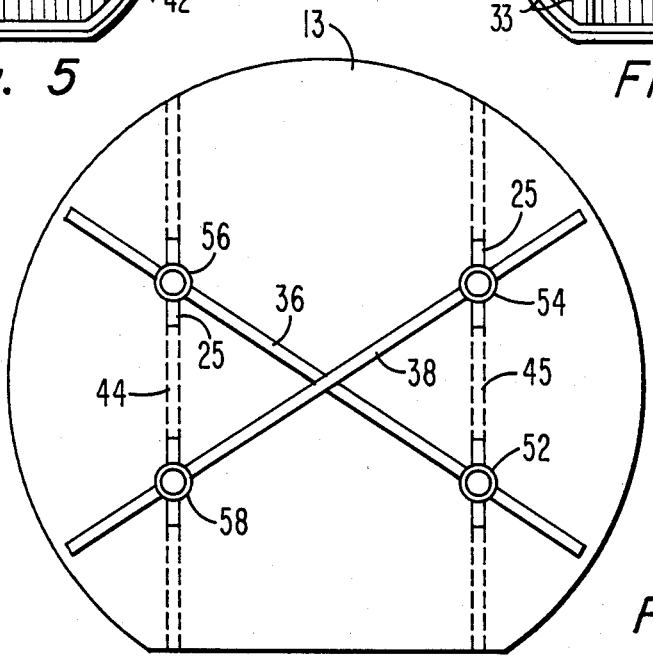
FIG. 7 illustrates the rear of the second reflector and the mounting means for connection to the satellite.

Referring to FIG. 7 there is illustrated the back view of the improved antenna system of FIG. 1. The lower reflector dish 13 and the upper reflector dish 11 and the rib structure ribs 34 and 35 are mounted to a support such as the spacecraft 74 in FIG. 2. Two crossed ribs 36 and 38 are bonded with epoxy to the back of reflector dish 13. Four mounting posts or legs 52, 54, 56 and 58 are secured by epoxy to the back of the reflector dish 13 at points behind the ribs 34 and 35. Each of the legs includes a collar fitting for mounting to the ribs 36, 38. Support gussets 25 are coupled to the collar and reflector and extend over the ribs 34 and 35.

In accordance with the teachings of the present invention a designer for such a dual gridded antenna system will first determine the field distribution across the antenna aperture which would vary depending on the desired antenna radiation pattern. With this in mind, the support ribs would be placed between the dishes such that the support rib crossing of the strong fields is minimized. The support ribs, when placed, would be such that they are either parallel or perpendicular to the rear reflector conductors.

Although the above embodiment describes parabolic reflectors, the teachings are applicable to any shape of gridded reflector.

What is claimed is:

1. A method for constructing a dual grid antenna reflector system of the type comprising a pair of polarized reflector dishes each having generally parallel oriented conductors with one of the reflector dishes to be mounted over the other dish in a spaced fashion using support ribs, such that the orientation of the conductors of the overlapped reflector is aligned with a desired linearly polarized radiation source and is orthogonal to of that of the conductors of the other reflector, comprising the steps of:

establishing the anticipated electric field distribution across the aperture of the overlapped reflector dish from the desired linearly polarized radiation source and placing the support ribs such that they are either parallel to and/or perpendicular to the orientation of the conductors of the overlapped reflector dish and such that they are substantially outside the established high field region.

2. The steps of claim 1 wherein said support ribs are placed parallel to the orientation of said overlapped reflector dish conductors.

3. The steps of claim 1 wherein said support ribs are placed perpendicular to the orientation of said overlapped reflector dish conductors.

4. The steps of claim 1 wherein said support ribs are perpendicular and parallel to the orientation of said overlapped dish conductors.

5. A dual gridded antenna reflector system for a spectrum reuse antenna system including a pair of orthogonally polarized linear radiation sources, said reflector system comprising:

a pair of reflector dishes, each of said dishes having a grid of parallel reflecting conductors with the conductors of each grid appearing parallel to each other from one of said linear radiation sources, means for mounting a first of said reflector dishes in spaced relation over said second reflector dish relative to said radiation sources to substantially overlap said second reflector dish and such that the grid of reflecting conductors of said first reflector dish are orthogonal to the grid of conductors of said second reflector dish, said mounting means including linear support ribs extending across said dishes, said support ribs extending either parallel to and/or perpendicular to the orientation of the second reflector dish conductors.

6. The combination of claim 5 wherein said support ribs are mounted as far as practical outside the high field region of said linear radiation source.

7. The combination of claim 6 wherein said mounting means includes a peripheral rib extending near the periphery of said reflector dishes and between said dishes, said support ribs extending across said dishes with their remote ends joined to said peripheral rib.

8. The combination of claim 7 wherein said reflector dishes are each sections of a paraboloid.

9. The combination of claim 8 wherein said peripheral rib is generally circular.

10. The combination of claim 5 wherein said support ribs are parallel to the orientation of the second reflector dish conductors.

11. The combination of claim 5 wherein said support ribs are perpendicular to the orientation of the second reflector dish conductors.

* * * * *